United States Patent [19]

Yamamoto

[11] Patent Number: 4,768,234

[45] Date of Patent: Sep. 6, 1988

[54] SKI GLOVE WITH A PROTECTOR

[75] Inventor: Tamenobu Yamamoto, Osaka, Japan

[73] Assignee: Yamamoto Kogaku Co., Ltd., Osaka, Japan

[21] Appl. No.: 127,575

[22] Filed: Dec. 2, 1987

Related U.S. Application Data

[63] Continuation of Ser. No. 931,887, Nov. 19, 1986, abandoned, which is a continuation of Ser. No. 821,594, Jan. 23, 1986, abandoned.

[30] Foreign Application Priority Data

Feb. 15, 1985 [JP] Japan ..... 60-20744
Oct. 7, 1985 [JP] Japan ..... 60-154252

[51] Int. Cl.[4] ..... A41D 19/00

[52] U.S. Cl. ..... 2/161 A; 2/16; 2/160

[58] Field of Search ..... 2/16, 160, 161 R, 161 A, 2/167

[56] References Cited

U.S. PATENT DOCUMENTS

| | | | |
|---|---|---|---|
| 3,404,409 | 10/1968 | Tillotson et al. | 2/161 R |
| 3,626,515 | 12/1971 | Murray | 2/161 A |
| 4,272,849 | 6/1981 | Thurston et al. | 2/161 R |
| 4,411,024 | 10/1983 | Hayes | 2/161 A |
| 4,484,359 | 11/1984 | Tirinen | 2/161 A |
| 4,570,269 | 2/1986 | Berlese | 2/161 A |

FOREIGN PATENT DOCUMENTS

| | | | |
|---|---|---|---|
| 2441763 | 3/1976 | Fed. Rep. of Germany | 2/161 R |
| 2456289 | 6/1976 | Fed. Rep. of Germany | 2/161 A |
| 1179448 | 5/1959 | France | 2/161 R |

*Primary Examiner*—Louis K. Rimrodt
*Attorney, Agent, or Firm*—Koda and Androlia

[57] ABSTRACT

The glove with the protector wherein the protector provided on the back of the glove is constituted by a multiplicity of protector elements, each protector element has its margin curved, the margin being gradually inclined, possesses the sliding surface, is formed of the material whose quality is harder than that of the surface material of the glove, being different from the latter quality thereof, an exposure of the sliding surface from the back enables the impact caused by the collision against the obstacle and the friction against the obstacle to be given a relief, a disposition of each protector element at certain amount of intervals between protector elements ensures a free action, such as the expansion, the contraction, the griping and the like, of the hand and the arm drawing on the glove, and the cost for producing the glove is reduced.

1 Claim, 4 Drawing Sheets

SKI GLOVE WITH A PROTECTOR

FIELD OF THE INVENTION AND RELATED ART STATEMENT

This is a continuation of application Ser. No. 931,887 filed Nov. 19, 1986, now abandoned, which is a continuation of application Ser. No. 821,594, filed Jan. 23, 1986, now abandoned.

The present invention relates to a glove with a protector used in the ski race, a motocross of the motorbike race, an endurance race which have a possibility of giving a damage to a hand and a back of a forearm, when the racer collides against an obstacle or turns over.

A slalom serves as an example of using the glove with the protector. The slalom is a competition in which the races try to ski out between each pair of gate of 40–70 pairs, which are erected on the slope having 120–220 m of height differece, without missing one gate so that the racers may contend with one another for reaching a goal as soon as possible at such a minute rate of 1/100–1/1000 sec. in arrival time at a finish. The width of the gate is less than 3.2–4 m, and the gates may be erected in such a way that the distance between the gates is as short as 75 cm. For this reason, the amateur feels that the gates are erected close together like a grove and cannot intuitively understand where he should ski through. The average skiing speed per hour is around 30 km and since ¼ of the entire course is inclined by more than 30 degrees, the maximum speed attainable is over twice as high as the average one. When the racer skis between the gate with a minimum skiing distance being selected at such a high speed, naturally, his hands and arms get in contact with any pole of gate comprising a banboo, a glass fiber, an aluminium and the like or while he mows down the poles of the gates with his hands and arms, he makes a descent, so the injuries which he is given at that time is beyond imagination. In order to give relief to such an impact, the glove with the protector having the following structure is used.

First of all, as shown in FIGS. 8 and 9, the protector 10, found conventionally, has leathers being thicker than those of surface element of the leathermade glove 11 mounted to the section, divided into 2–3 of small parts, to be protected, located on the back b, fingers d and e and the like of the glove 11, in a stitchlike manner by means of a thread 12 at the intervals S the distance of which is approximately as long as the extent of that the hands and the arms can be free to perform action such as an expansion, a contraction, a griping.

In addition to that, as shown in FIGS. 10 and 11, in order to enhance further the protecting effect by the protector 10, it has, similarly to the foregoing example, the thinner leathers 14 in which cushioning materials such as a sponge are one by one wrapped, mounted to the section, divided into several small parts, to be protected, located on the back b, fingers d and e and the like of the leather-made glove 11, in a stitchlike manner by means of the thread 12 at the intervals the distance of which is approximatle as long as the extent of that the hands and the arms can be free to perform the action such as the expansion, the contraction, the griping.

In the case of using the foregoing glove with the protector for the slalom, when the hands and the arms of the racer get in contact with the poles of the gates, in addition to that the surface of the protector 10 by itself is made of the leather possessing a relatively larger coefficient of friction, an occurrence of "scratching" part by margings to sew 15 gives rise to so serious friction that during their repeated contact with the poles of the gates the descending speed is more and more decelerated, resulting in an induction of fatal time loss in the race in which a minimumization at a rate of 1/1000 sec. is contended for.

As for a making process of the protector 10, since it is mounted to the glove 11 in a stitchlike manner, hand work must be relied on. In particular, in the latter example, since, wrapping one by one the cushioning materials 13 in each of the thinner leaters 14, the leathers 14 are mounted to the glove in a stitchlike manner, the number of processes gets numerous, and the costs are very increased. In connection with numerous number of processes, the stitchlike mounting mode unavoidably puts a limit to the shape and the magnitude of protector so that it is enlarged, and when using the glove to which the protector 10 is mounted, the protector 10 gives an influence to the functional factor, it obstructing the free action such as the expansion, the contraction, the griping of the hands, the wrists, the arms and the like. Furthermore, the stitchlike mounting of the protector 10 to the glove occurs a multiplicity of machinestitches, so when using such a glove for skiing, there is a bad effect in which the skier feels discomfort due to a permeation of snow water.

OBJECT AND SUMMARY OF THE INVENTION

The first purpose of the present invention is to provide the glove with the protector which decreases the frictional resistance of the hands and the arms against the obstacle and the like, caused by contact with and collision against the obstacle, overcomes the cause for the time loss in particular in the case of using such a glove, gives a relief to the injury received by the hands and the arms, and enhances its protecting effect.

The second purpose of the present invention is to adapt the magnitude, the shape, and the disposition of the protector of the glove with the protector to human engineering, have the protector fit the hand drawing on the glove, and acquire the free action of the hands.

The third purpose of the present invention is that when mounting the protector to the glove, by means of adopting no sewing method, the making process of the glove with the protector is simplified and intended to reduce its cost, and by means of minimumizing the machine stitches, a permeation of water into the protector is prevented.

Such purposes of the present invention are attained by the construction of the glove with the protector, having the back of the glove equipped with the protector, in which the protector is constituted by a multiplicity of protector elements, and each of protector elements makes its margin curved, possesses a sliding surface, is harder than the surface material of the glove, is formed of the material whose quality is different from that of the surface material of the glove, while it exposes the foregoing sliding surface from the back, it is disposed at intervals the distance of which is approximately as long as the extent of obstructing no free action such as the expansion, the contraction, the griping of the hand and the arm drawing on the glove, and is mounted to the glove by a fixing means such as an insert forming, a high frequency, a supersonic wave, a heat welding, an application of adhesive and the like.

According to the present invention, the protector provided on the back of the glove being constituted by a multiplicity of elements, by the construction in which each of the protctor elements has its margin curved, possesses the sliding surface, is harder than the surface material of the glove, is formed of the material the quality of which is different from that of the surface material of the golve, and has the foregoing sliding surface exposed from the back. In the case of using the glove particularly for the slalom, when the hands and the arms of the racer get in contact with the poles of the gates, the poles slide on the sliding surface of the element provided on the glove without the frictional resistance, and even if they collide against the margin, they slide lightly on its surface so that, because there is reduced the frictional resistance, a cause for the time loss is markedly decreased, and, at the same time, an impact caused at the collision is impact-diffused or absorbed into the sliding surface, thereby maximumizing the protecting effect.

Furthermore, the protector provided on the back of the glove is constituted by a multiplicity of elements, such elements are disposed at intervals the distance of which is approximately as long as the extent of obstructing no free action such as the expansion, the contraction, and the griping of the hand and the arm drawing on the glove, and they are disposed so that their magnitude and shape adapts to human engineering, they follow faithfully a motion of the hand drawing on the glove, thereby making it possible to acquire the free action such as the expansion, the contraction, and the griping of the finger, the hand, the wrist, and the arm. Furthermore, this makes the design of the glove superior and sharp, and gives rise to the impression that such a glove is truly faster, stronger, and more safe, thereby giving a good influece to the spiritual condition of the racer.

The glove of the present invention, when it is made, has the protector element mounted to the glove by the fixing means, excluding the stitchlike means, such as the insert forming, the high frequency, the supersonic wave, the application of adhesive, so the cost of the former means is lower than that of stichlike mounting mode of the protector, and because according to the fixing means, the machine stitches on the surface of the glove can be more remarkably reduced than the conventional ones, no discomfort caused by a permeation of the snow water during skiing, and muddy water during motorcrossing of the motorbike into the glove is given to the hands.

DETAILED DESCRIPTION OF PREFERRED EMBODIMENTS

A detailed description of the embodiments according to the present invention is made in conjunction with the accompanying drawings as follows:

FIGS. 1–6 illustrate the first preferred embodiment according to the present invention. As illustrated, the glove with the protector of the present invention has the back of the glove equipped with the protector, which is constituted by a multiplicity of protector elements (hereinafter referred to as element 1). Namely, by means of dividing the protector into a multiplicity of elements 1 to dispose them as said above, the protector is adapted to follow a motion of the hand drawing on the glove as faithfully as possible.

Figure 2:
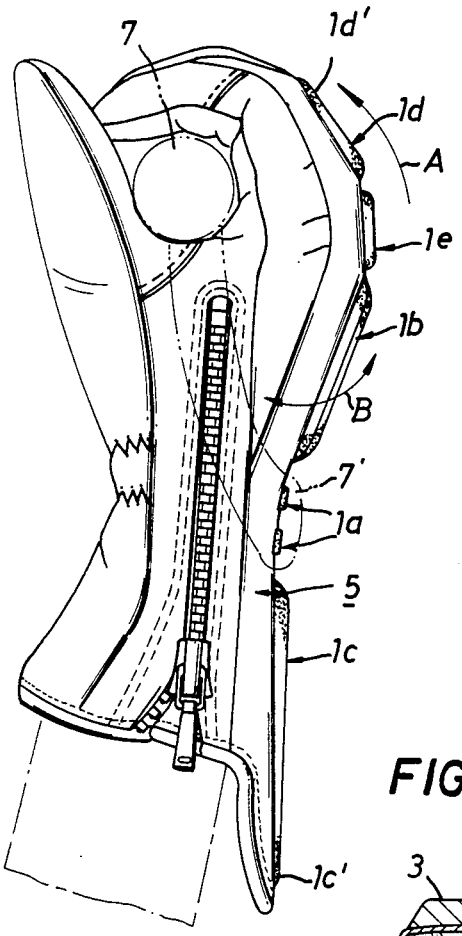
FIG. 2 is a side view of the first embodiment under state of which a stock is grasped.

Although it is, of course, acceptable, to dispose the foregoing element 1 on the entire section of the back, as apparent from FIG. 2, taking the mode of the fingers and the hands at using the glove into account may show that there is no necessity of disposing intentionally the element 1 around finger tips and a thumb, and that it is rational if the element 1 is provided from the section slightly nearer to the back than to second joints of four resting fingers to the forearm.

Figure 1:
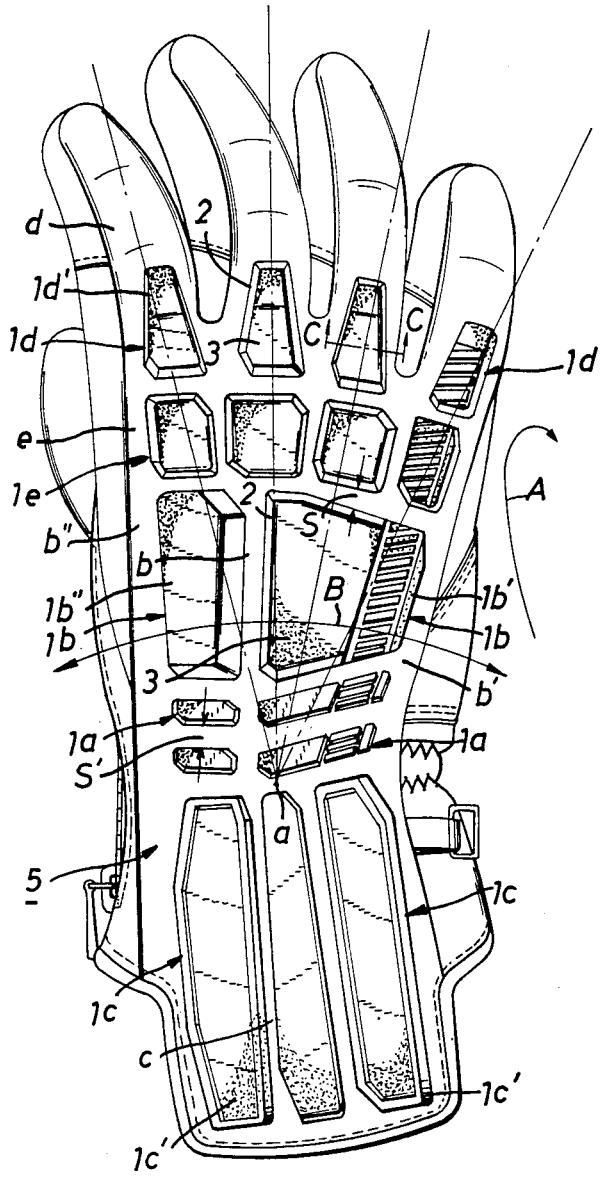
FIG. 1 is a plan view of the first embodiment of the present invention.

If each of the elements 1 is radially disposed in direction toward the finger tips with the part corresponding to the wrist a of the glove being as a center, the element running along such a dashed line as shown in FIG. 1, i.e. along the hand drawing on the glove on the basis of the human engineering, it enables the protector respond faithfully in a direction as shown by arrow B in addition to a direction as shown by arrow A along which a motion of grasp by the hand takes place, i.e. to a motion in a laterally expanded direction of the palm of the hand.

The distance of the interval between the elements 1 is disposed to produce a space approximately as long as the extent of obstructing no free action such as the expansion, the contraction, the griping of the hand and the arm. For this reason, it is preferable that the distance of the interval S, which is positioned on the back b and the forearm c giving rise to comparatively more stationary motion, may be more narrow, whereas the distance of the interval S , which is positioned on the fingers d and e and the wrist a demanding their sensible motion, may be more wider. In that case, such a distance ought to be designed such that it is not extrodinarily larger in terms of that the part provided with the interval S is not protected.

Figure 6:
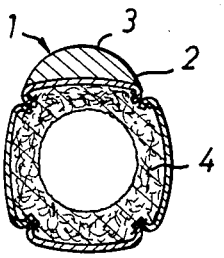
Figure 4:
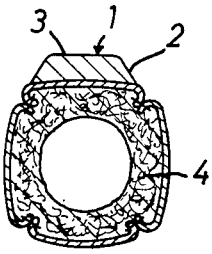

Next, the shape and the magnitude of each element 1 are individually determined, depending upon a site of the hand for which the element 1 makes protection, particularly upon the size of a bone. Namely, while it is acceptable that the element 1 being positioned on the site, such as the back b and the forearm c, which is larger in surface area, giving rise only to a comparatively more stationary motion, is larger, the element 1 being on the site, such as the fingers d and e and the wrist a, which is demanded its sensible motion ought to be smaller. In addition, each element 1 has its margin 2 curved, possesses the sliding surface 3, and the sliding surface 3 is disposed such that it is exposed from the surface of the glove. The foregoing margin 2 gets acceptably curved by being chamfered as shown in FIG. 4, while it may be also of circular in section as shown in FIG. 6. In any case, it is recommendable that the margin 2 is adapted to be gradually inclined. A detailed description of each element 1 is made every the part protected by it on the basis of the drawings as follows. Such a desciption is set such that, depending on the position on which the elements 1 are disposed in the drawings, the symbol 1 of the element and the symbols (a–e) of the positions make pairs, for example 1*a*, 1*b* and the like being manifested:

The element 1*d*, which is disposed on the toppest end of the finger d of the glove, between the elements 1*d* and 1*e* being disposed thereon employs a platelike block-shaped article whose top end 1*d*′ is narrow approximately like a triangle, and is formed such that it is gradually inclined with being thinner in proportion to being directed to its top as illustrated in FIG. 2.

Next, the element 1*b*, being disposed on the back b of the glove, which has two pieces of comparatively larger platelike block-shaped articles disposed in parallel with each other, is formed such that both of the elements 1*b* being positioned on the outer side b′ of the back and the inner side b″ thereof are gradually inclined with being thinner in proportion to be directed to its outer end 1*b*′ and its inner end 1*b*″ respectively.

The element 1*a*, being disposed on the position corresponding to the wrist a of the glove, which is comparatively thinner and smaller, is formed to be narrow and long sidways in order to bend easily the wrist, and the distance of the interval S′ between the elements 1*a* and 1*a* is larger than the distance of the interval S.

The element 1*c*, being positioned on the forearm c of the glove, which is comparatively larger, more narrow, and longer longitudinally, is formed such that it is gradually inclined with being thinner in proportion to being directed to the upper warm, and 2–3 pieces of elements 1*c* are provided in parallel with one another in a lengthwise direction of the glove.

As mentioned above, by means of forming the ends 1*d*′, 1*b*′, 1*b*″, and 1*c*′ of the elemets 1*d*, 1*b*, 1*c* being disposed on the topest end d, the back b, and the forearm c of the finger of the glove such that they are gradually inclined to be thinner, even in the case where the poles collide against any of the ends 1*d*′, 1*b*′, 1*b*″, 1*c*′, the poles are adapted to slide on the sliding surface 3 without being "scratched" and the frictional resistance and the impact are given remarkably relief. Futhermore, since the element 1*a* being disposed on the wrist a of the glove is formed to be thinner, this part is lower than other part so that there is a convenience that when grasping the stock 7, a string 7′ of the stock 7 can be held in this part.

The material of each element ought to be determined, depending upon the mode and the purpose of using the glove on which the elements 1 are disposed. Namely, it is self-explanatory that the most important role as which the element 1 serves lies only in a reduction of the frictional resistance against an object caused by the collision as well as the relief given to the resulted impact. For this reason, as the material for the element 1 possessing the foregoing properties, a hard material such as a ceramic, a light alloy and the like, a hard synthetic resin, whose elastic modulus is more than $10^5$ psi, such as phenolic resin and ABS resin, a semi-hard synthetic resin, whose elastic modulus is $10^4$ psi–$10^5$ psi, such as an urethane, EVA (an ethylene and a vinyl acetate) and the like, or a soft synthetic resin whose elastic modulus is less than $10^4$ psi are exemplified, out of the range of which a selection may be made, taking the foregoing using mode into account. However, so far as the glove with the protector used for the afore-mentioned ski race may be concerned, the urethane & EVA, belonging to the semi-hard synthetic resin, whose moderate hardness causes the impact to slide on the sliding surface and whose moderate softness absorbs the impact, are preferably used. In addition, it is possible that the nature of the element 1 being disposed on the glove is subject to the position at which the element 1 is disposed, e.g. the element 1*b* disposed on the back b of the glove employs hard properties, while the elements 1*d* and 1*e* disposed on the parts corresponding to the fingers d and e respectively adopt soft properties.

Next, the glove, by itself, on which the foregoing element 1 is disposed is referred to. Namely, the shape of the glove may be, as shown in FIGS. 1 and 2, a type of possessing generally five fingers, is acceptably a mitt system in which four fingers excluding the thumb are unified as one, and in terms of giving a respect to a motion of the hand drawing on the glove, it is recommendable that in addition to using of the common glove having five fingers, such a glove has the forearm c extended in consideration of a protection of the forearm c. As the surface material of the glove, the leather such as a common cowhide, an artificial leather, a rubber, a soft synthetic resin sheet possessing waterproof properties and a moisture permeability, a knitted cloth, a woven cloth, & an unwoven cloth are used in an individual or combinatory manner, and the inside of the glove is equipped with a middle cotton 4, made of various kinds of materials, possessing a heat insultating effect and a cushioning effect.

The mounting of a multiplicity of elements 1 on the foregoing glove is performed by using the fixing means excluding the stitching method. For example, the using of the adhesive or in the case where the element 1 is made of the synthetic resin, the welding utilizing the insert forming, the high frequency, and the supersonic wave is suitable. In that case, particularly, if as the surface material of the glove, a knitted material utilizing a synthetic resin thread such as a polyester, a nylon and the like is used, it is possible that the insert forming causes each element to be mounted on the surface material of the glove at the same time of forming the element 1, resulting in an attainment of the most suitable mounting mode in which an anchor combination or the welding helped by a slight thermal fusion of the surface material of the glove at the insert forming is performed. At that time, it is preferable that the surface material to which a water repellant treatment is applied in advance is used or that after mounting the element 1 on the surface material, the water repellent treatment is applied to the exposed part of the surface material. For this reason, in response to that, in addition to making the glove only by using a single surface material, if the knitted material utilizing the synthetic resin thread is used only for the material 5 of the back of the glove on which the element 1 is disposed and another material such as the leather is used for the material of other part thereof, it brings further advantageousness. That means that, accompanied with the expansion, the contraction, and the griping of the glove, if the material 5 of the back of the glove which is demanded for a stretching of the back adopts the knitted material which utilizes the synthetic resin thread being better in a degree of shrinkage, it enables the glove to give rise to favorable fitness such that it follows faithfully a motion of the hand.

Figure 3:
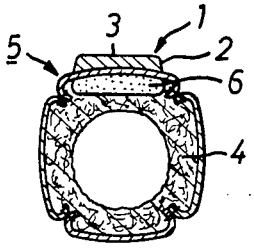
FIG. 3 is a sectional view taken on the line C—C of FIG. 1.
Figure 5:
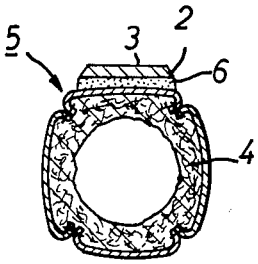
FIGS. 4 to 6 are sectional views of another embodiment corresponding to FIG. 3.

In addition to the disposition of each element 1 on the back of the glove, as shown in FIGS. 3 and 5, sectional views taken on the line C—C of FIG. 1, if the cushioning material 6, softer than the element 1, comprising, for example, a rubberlike foaming article, a resinlike foaming article, a gelling silicon and the like is disposed in response to each element 1, it acquires further higher protecting effect.

Such an arrangment as shown in FIG. 3 has the cushioning material 6 disposed inside the glove positioned correspondingly to the element 1 with the material 5 of the back of the glove interposed between the element 1 and the cushioning material. In such a case as shown in FIG. 5, the cushioning material 6 is interposed between the element 1 and the surface material 5 of the glove.

Thus, by means of providing the cushioning material 6 except for the element 1, particularly in the case of employing the hard material for the element 1, a primary impact caused by the collision is impact-diffused by the sliding surface 3 of the hard element 1, and subsequently the secondary impact which is not given full relief is absorbed into the cushioning material 6, thereby making it possible to enhance the protecting effect of the protector provided on the glove to large extent.

Figure 7:
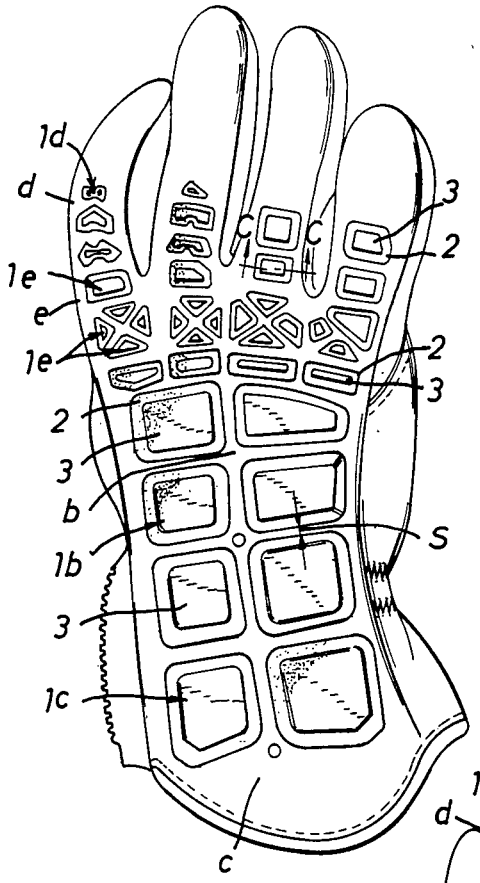
FIG. 7 is a plan view of the second embodiment of the present invention.
Figure 8:
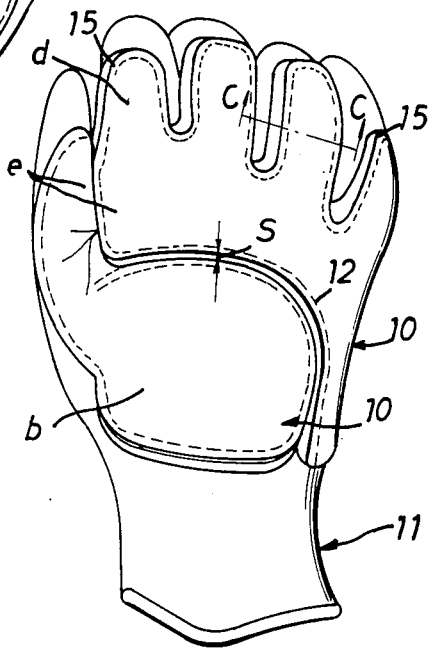
FIG.8 PRIOR ART
FIG. 8 is a plan view of the conventional glove with the protector.
Figure 10:
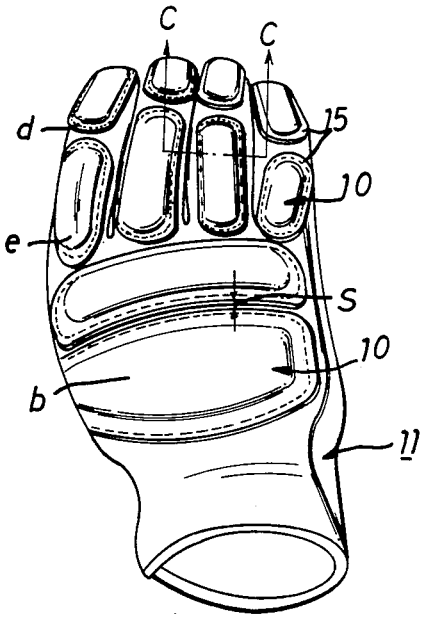
FIG.10 PRIOR ART
FIG. 10 is a plan view of another conventional glove with the protector.
Figure 9:
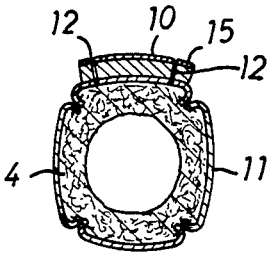
FIG.9 PRIOR ART
FIG. 9 is a sectional view taken on the line C—C of FIG. 8.
Figure 11:
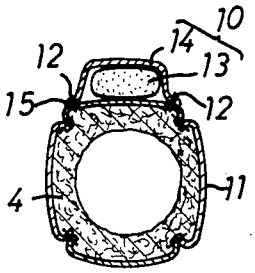
FIG.11 PRIOR ART
FIG. 11 is a sectional view taken on the line C—C of FIG. 10.

Next, the second embodiment of the present invention is described in conjunction with FIG. 7: Similarly to the first embodiment, in such a manner as shown in the drawing, the second embodiment is also equipped with the protector on the side of the back from the part nearer to the back b than to the second joint of the fingers d and e of the glove to the forearm c, and the protector is constituted by a multiplicity of elements 1 being formed into the plate-shaped block article. Each element 1 possesses the sliding surface 3, and, as shown in FIGS. 4 and 6, its margin 2 is chamfered to get gradually inclined or is formed to be of circular in section, getting curved. The magnitude and the shape of each element 1 are determined by the position on which the element 1 is disposed. Namely, the site to be protected by the element 1 providing the magnitude and the shape thereof with a variety, for example, with regard to the site, larger in surface area and comparatively more stationarily movable, such as the back b and the forearm c of the glove, the larger elements **1*b* & 1*c* respectively are acceptable, while regarding the site, subtly movable, such as the fingers d and e, a consideration of such properties adapts the smaller elements 1*d* and 1*e* respectively to be disposed, and, in particular, the element 1*e* being disposed on the joint is subdivided, as shown in the drawing, the shape of each element 1 being of form such as a square, a triangle, a home base of baseball and the like. As pointed out in the first embodiment, the hardness of the element 1 is adequately determined, depending upon the purpose of using the same. In addition to the fixing means, excluding the stitchlike method, such as the using of the adhesive and the insert forming, similarly to the first embodiment, if the matter with forming properties is used as the foregoing adhering material, or, as shown in FIG. 5, the foaming material is interposed between the element 1 and the material 5** of the back of the glove in order to absorb the impact, the protecting effect is extremely enhanced. The material of the glove, similarly to the first embodiment, may adopt various kinds of materials.

I claim:

1. A glove for ski wear, comprising on a back surface a plurality of protector elements arranged with such spaces as will not hinder grip action of a hand or other free actions of the hand and arm, wherein a cushioning material is provided on an inside surface of the back of the glove in alignment with the protector elements with the glove interposed therebetween, where the protector elements are formed of separate plates with inclination at peripheries for sliding, wherein the material for said protector elements is a hard synthetic resin having an elastic modulus more than $10^5$ psi selected from the group consisting of phenolic resin and ABS resin or of a semihard synthetic resin having an elastic modulus less than $10^5$ psi selected from the group consisting of urethane and EVA, and wherein a base of the back surface of the glove is formed of a knitted material of synthetic yarn and is directly combined by insert forming with said resin forming inner portion of the protector elements in a state of being embraced with said resin which has intruded into spaces formed between knitted yarns during the insert forming.

* * * * *